US010646741B2

(12) United States Patent
Chen et al.

(10) Patent No.: US 10,646,741 B2
(45) Date of Patent: May 12, 2020

(54) WEIGHT TRAINING EQUIPMENT WITH SENSOR

(71) Applicant: FOXCONN INTERCONNECT TECHNOLOGY LIMITED, Grand Cayman (KY)

(72) Inventors: Cheng-Pang Chen, New Taipei (TW); Chang-Wei Kuo, New Taipei (TW); Yi-Chung Teng, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 93 days.

(21) Appl. No.: 15/870,877

(22) Filed: Jan. 13, 2018

(65) Prior Publication Data

US 2018/0200561 A1 Jul. 19, 2018

(30) Foreign Application Priority Data

Jan. 14, 2017 (CN) ..... 2017 1 0026562

(51) Int. Cl.

*A63B 21/062* (2006.01)
*A63B 21/08* (2006.01)
*A63B 21/00* (2006.01)

(52) U.S. Cl.

CPC ..... *A63B 21/063* (2015.10); *A63B 21/0622* (2015.10); *A63B 21/0628* (2015.10); (Continued)

(58) Field of Classification Search

CPC ..... A63B 21/063; A63B 21/0624; A63B 21/0626; A63B 21/0632; A63B 21/0628; (Continued)

(56) References Cited

U.S. PATENT DOCUMENTS 4,700,500 A * 10/1987 Slappey, Jr. ..... F41A 11/00 42/90
5,000,446 A * 3/1991 Sarno ..... A63B 21/063 482/101
2016/0346617 A1* 12/2016 Srugo ..... G09B 19/0038

FOREIGN PATENT DOCUMENTS

CN 206183856 U * 5/2017 ..... A63B 24/0062
TW M433556 7/2012

OTHER PUBLICATIONS

SavageRodent. HC-SR04 Casing+ Angle Adjustable Cradle. [Dated Sep. 30, 2016]. [Retrieved on May 30, 2019] Retrieved from the Internet (Year: 2016).*

* cited by examiner

*Primary Examiner* — Andrew S Lo
*Assistant Examiner* — Zachary T Moore
(74) *Attorney, Agent, or Firm* — Wei Te Chung; Ming Chieh Chang

(57) ABSTRACT

A weight training equipment with an ultrasonic sensor assembly including a transmitter unit, a receiver unit, a case and the support. The case is rotatably supported upon the support to expose the transmitter and the receiver upwardly. A freely rotatable pin unit is selectively inserted into the hole of the corresponding weight block of the weight training equipment to have its reflection surface downwardly face the sensor assembly. A distance between the pin unit and the sensor assembly during exercise can be measure by ultrasound transmitted from the transmitter unit toward the pin unit and further reflected by the reflection surface and received by the receiver unit.

12 Claims, 11 Drawing Sheets

(52) U.S. Cl.
CPC ..... *A63B 21/00047* (2013.01); *A63B 21/08* (2013.01); *A63B 21/4035* (2015.10); *A63B 21/4047* (2015.10); *A63B 2220/52* (2013.01); *A63B 2220/803* (2013.01); *A63B 2220/89* (2013.01)

(58) Field of Classification Search
CPC ..... A63B 21/0622; A63B 21/4047; A63B 21/4035; A63B 21/00047; A63B 21/08; A63B 2220/803; A63B 2220/80–89; A63B 2220/52; Y10T 16/484; Y10T 16/498
See application file for complete search history.

WEIGHT TRAINING EQUIPMENT WITH SENSOR

FIELD OF THE DISCLOSURE

The invention is related to a weight training equipment with corresponding sensors.

DESCRIPTION OF RELATED ARTS

Taiwan Utility Patent No. M433556 discloses the weight training equipment is equipped with a sensor set including a plurality of magnetic sensors for indicating the training status. Anyhow, such sensors takes more space and cost more money. A saving space and simple structure sensor arrangement is desired.

SUMMARY OF THE DISCLOSURE

An object of the invention is to provide a weight training equipment with an ultrasonic sensor assembly including a transmitter unit, a receiver unit, a case and the support. The case is rotatably supported upon the support to expose the transmitter and the receiver upwardly. A freely rotatable pin unit is selectively inserted into the hole of the corresponding weight block of the weight training equipment to have its reflection surface downwardly face the sensor assembly. A distance between the pin unit and the sensor assembly during exercise can be measure by ultrasound transmitted from the transmitter unit toward the pin unit and further reflected by the reflection surface and received by the receiver unit.

DETAILED DESCRIPTION OF THE PREFERRED EMBODIMENT

Figure 1:
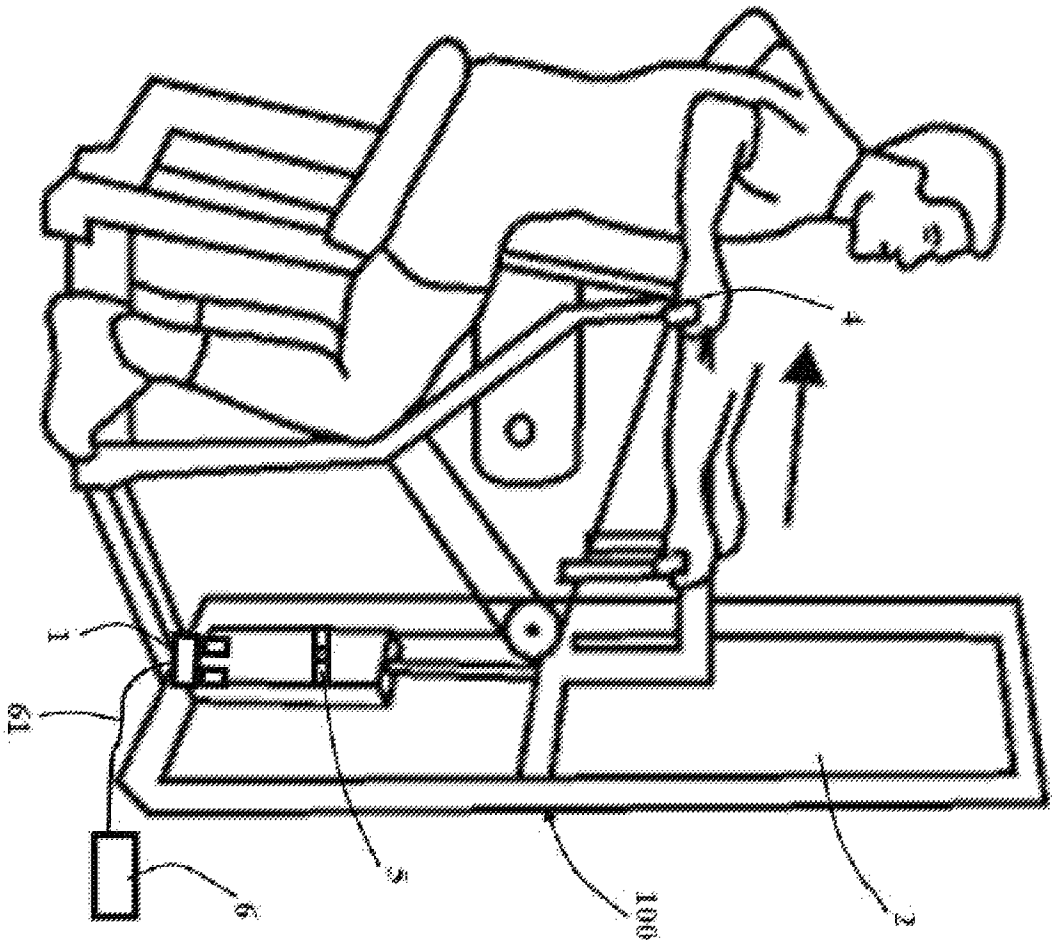
FIG. 1 is a perspective view of the weight training equipment operated by a user according to the invention.
Figure 2:
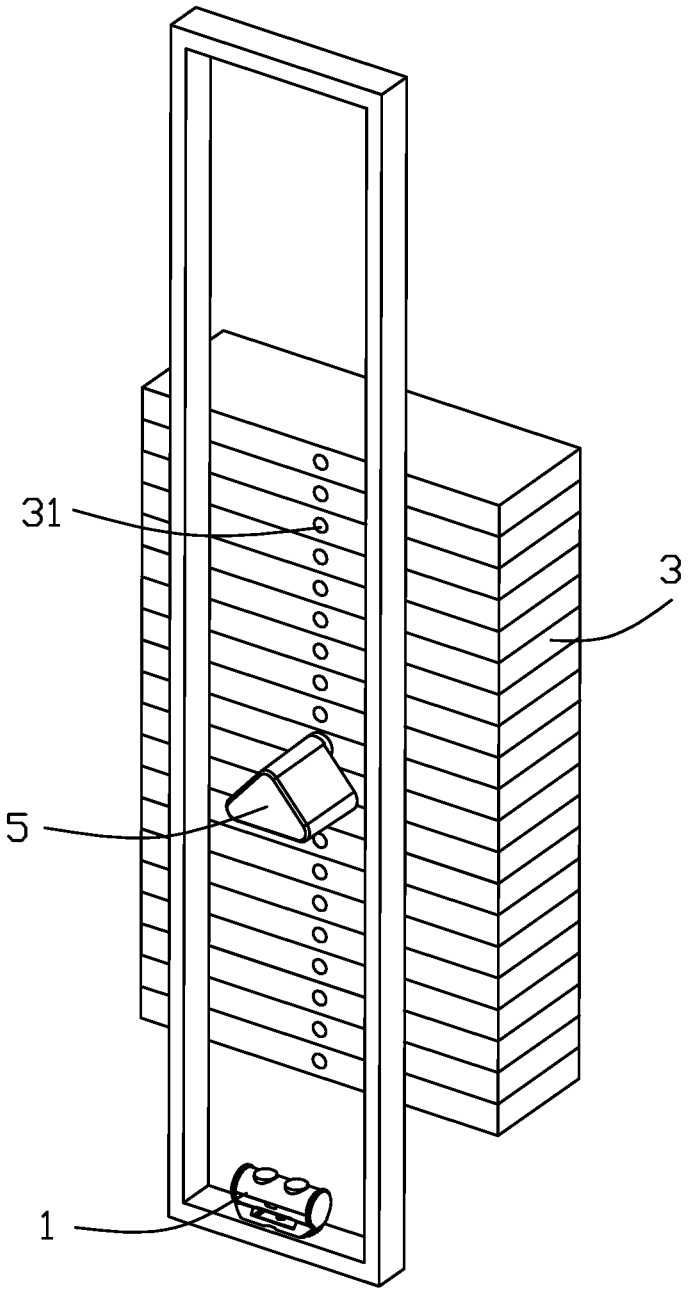
FIG. 2 is a perspective view of the weight block section of the weight training equipment and the associated ultrasonic sensor assembly and rotatable pin unit thereof according to the invention.
Figure 3:
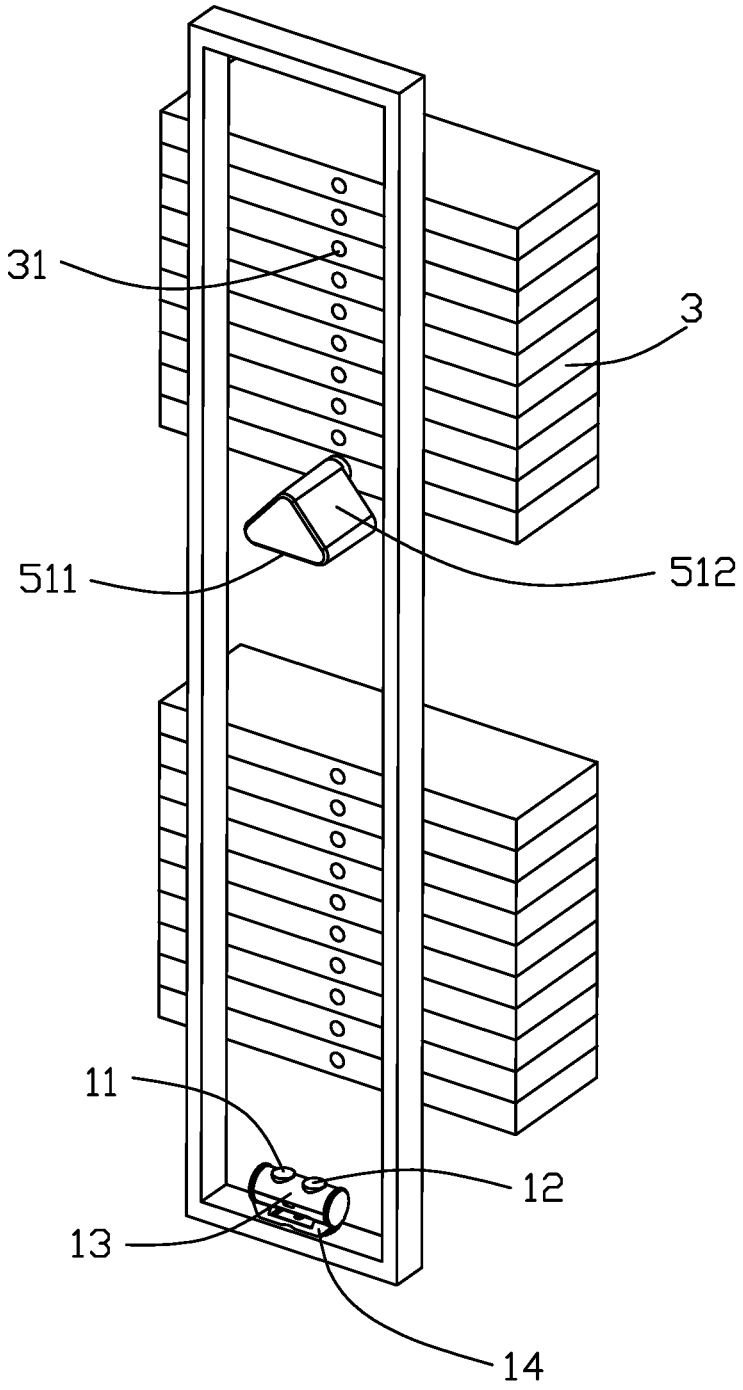
FIG. 3 is a perspective view of the weight training equipment and the associated ultrasonic sensor assembly and rotatable pin unit of FIG. 2 in a lifting state.
Figure 4:
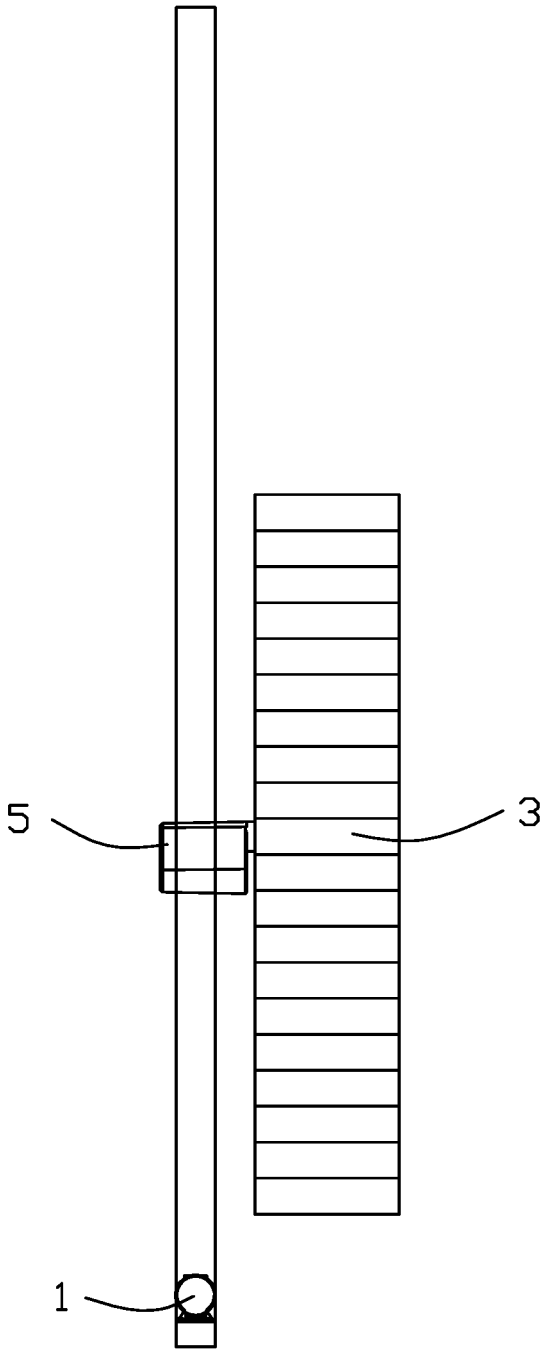
FIG. 4 is a side view of the weight training equipment and the associated ultrasonic sensor assembly and rotatable pin unit of FIG. 2.
Figure 5:
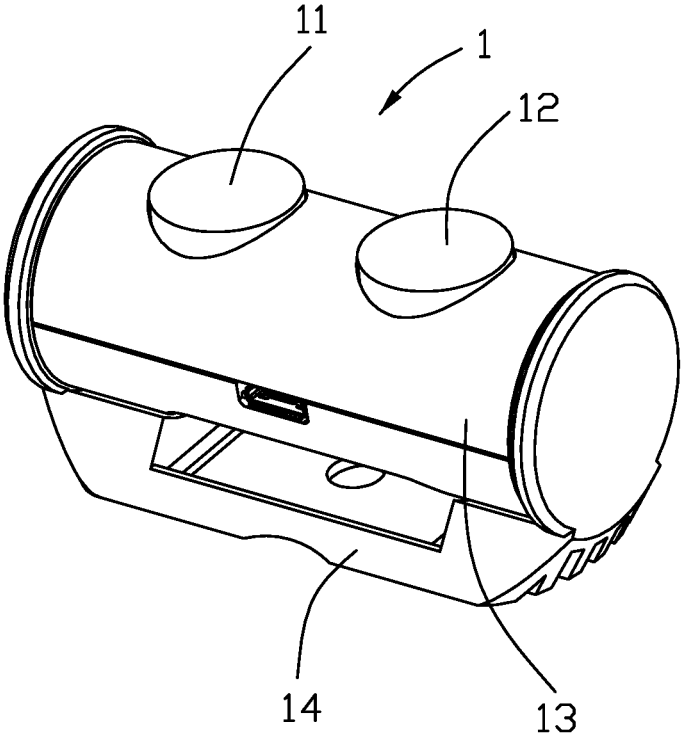
FIG. 5 is a perspective view of the ultrasonic sensor assembly of FIG. 2.
Figure 6:
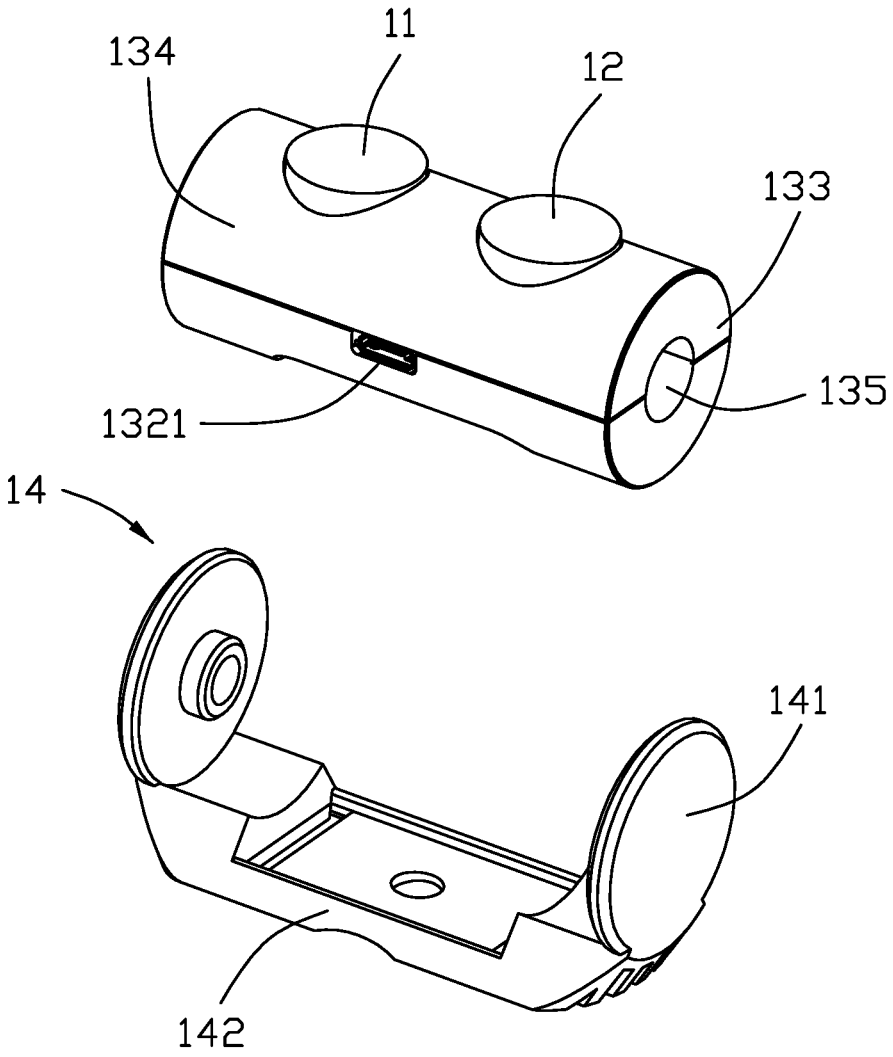
FIG. 6 is an exploded perspective view of the ultrasonic sensor assembly of FIG. 5.
Figure 7:
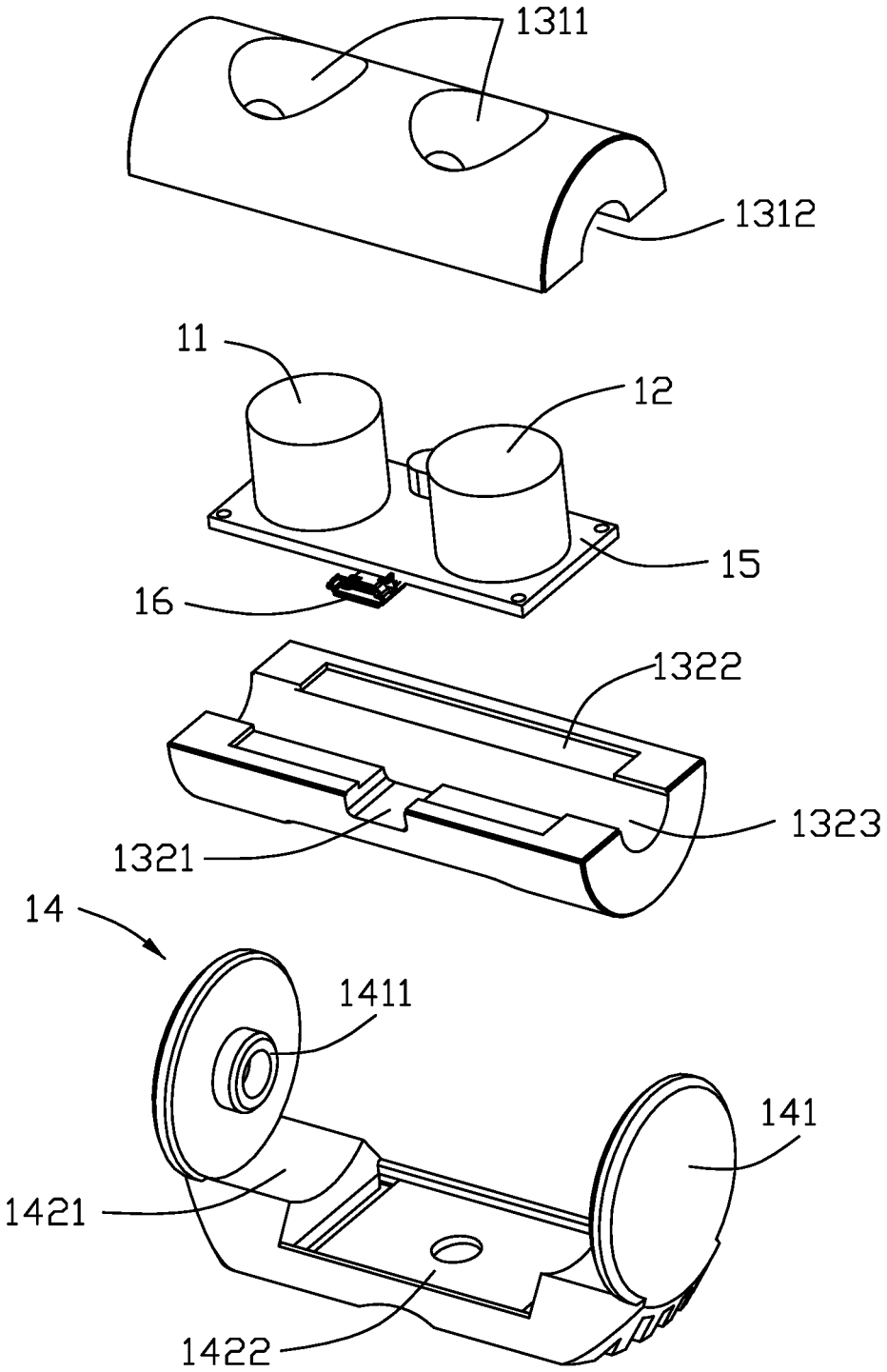
FIG. 7 is a further exploded perspective view of the ultrasonic sensor assembly of FIG. 6
Figure 8:
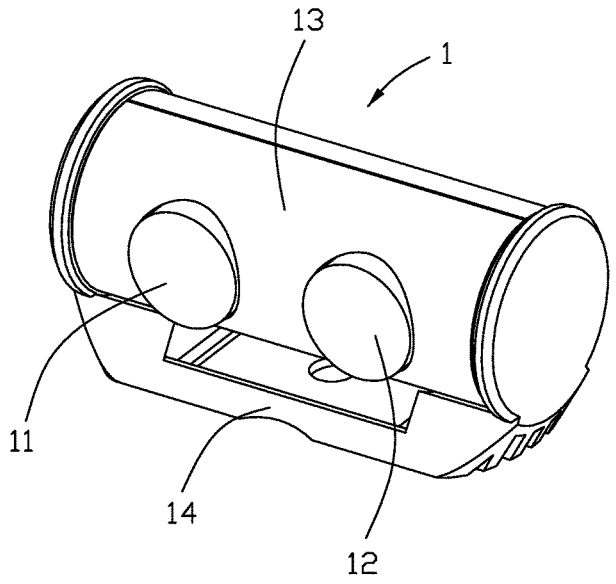
FIG. 8 is a perspective view of the ultrasonic sensor assembly of FIG. 5 in a rotated/non-upstanding manner.
Figure 9:
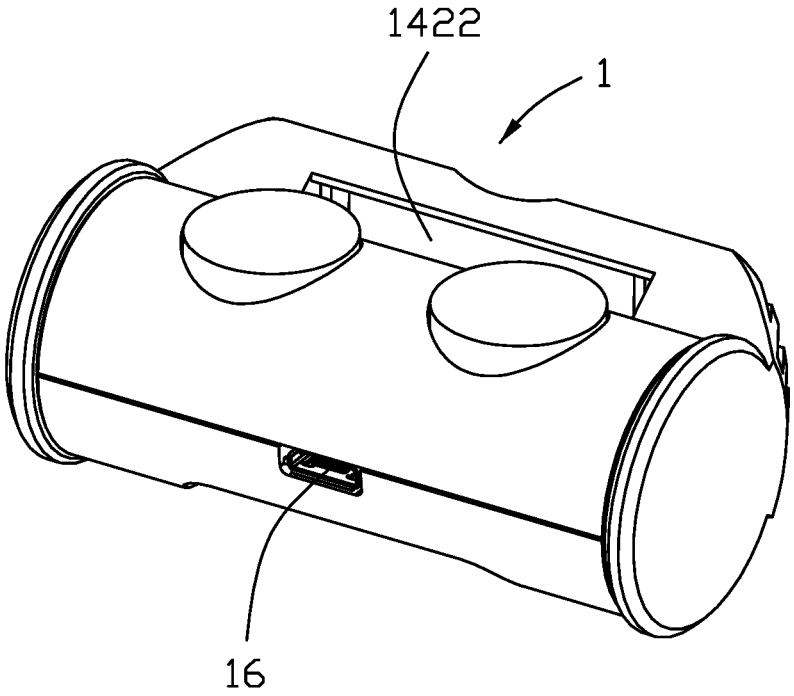
FIG. 9 is a perspective view of the ultrasonic sensor assembly of FIG. 8 in another rotated/non-upstanding manner.
Figure 10:
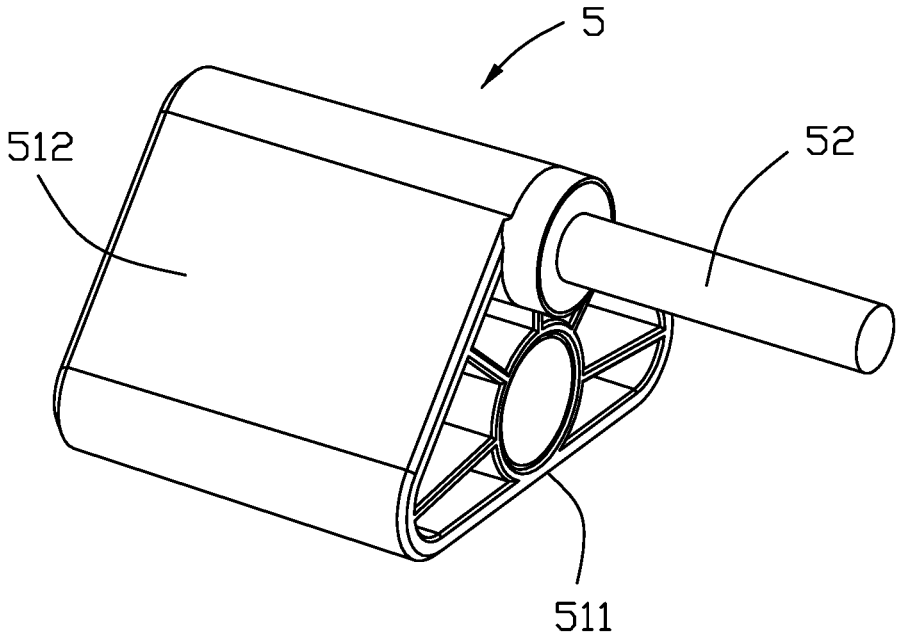
FIG. 10 is a perspective view of the rotatable pin unit of FIG. 2.
Figure 11:
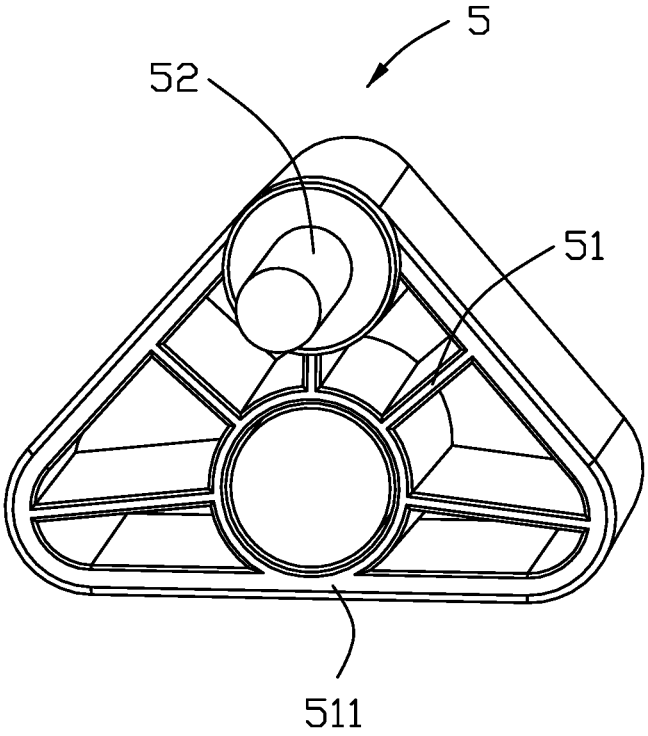
FIG. 11 is another perspective view of the rotatable pin unit of FIG. 10.

Referring to FIGS. 1-11, A weight training equipment includes an ultrasonic sensor assembly 1, a frame 2, a plurality of weight blocks 3, a transmission mechanism 4, a rotatable pin unit 5 adapted to be inserted into any weight block 3, and a data collection box 6 connected to the ultrasonic sensor assembly 1.

The ultrasonic sensor assembly 1 is attached to the frame 2 and under the weight blocks 3, and opposite to the pin unit 5. The ultrasonic sensor assembly 1 includes a transmitter unit 11, a receiver unit 12, a case 13 and a support 14, a substrate 15 on which the transmitter unit 11 and the receiver unit 12 are mounted, and a connector 16 for input/output.

The case 13 is of a column shape, including opposite end surfaces 133 and a circumferential surface 134 therebetween wherein the end surface 133 is circular while the circumferential surface 134 is rectangular when it is extended in a plane. The case 13 forms a pair of holes 1311 extending through the circumferential surface 134, and a pair of pivot holes 135 in the corresponding end surface 133. The case 13 includes the first part 131 and a second part 132 each having a semi-circular cylindrical shape. The first part 131 and the second part 132 commonly sandwich the substrate 15 therebewteen with the transmitter unit 11 and the receiver unit 12 exposed in the corresponding holes 1311, respectively. The first part 131 forms a channel 1312 extending through the end surfaces 133, and the second part 132 forms another channel 1323 extending through the end surfaces 133, so the channels 1312 and 1323 cooperatively form the corresponding pivot holes 135.

The second part 132 forms a notch 1321 extending outwardly through the circumferential surface 134, and a recess 1322 inwardly communicating with the channel 1323. In this embodiment, the substrate 15 is received in the recess 1233, and the connector 16 is located at an edge of the substrate 15 and received within the notch 1321. The support 14 includes a pair of opposite disks 141 and a stand 142 linked between the pair of disks 141. Each disk 141 includes a rotation shaft 1411 at the center so as to be received in the corresponding pivot hole 135. The stand 142 includes a pair of steps 1421 located inside/beside the corresponding disk 141 neighboring a lower region of the disk 141, and a cutout 1422 between the pair of steps 1421. Two opposite end regions of the case 13 are supported above the steps 1421, and the middle region of the case 13 is locate above the cutout 1422. Therefore, the case 13 can be rotated to different radial positions with regard to the support 14 via the rotation shaft 1411 retained in the pivot holes 135 for complying with the different weight training equipments.

The pin unit 5 includes a reflection section 51 and an insertion section 52. The reflection section 51 includes a bottom region 511 and a pair of oblique regions 512 arranged in an isosceles triangle. The insertion section 52 having a pin configuration, is located at the top apex, i.e., the intersecting point of the pair of oblique regions 52. Understandably, the bottom surface of the bottom region 511 is the so-called reflection surface. The weight block 3 includes an insertion hole 31 for insertion of the insertion section 52 selectively. The transmitter unit 11 and the receiver unit 12 of the ultrasonic control system 1 upwardly face toward the reflection section 51.

During exercising, the ultrasound emitted from the transmitter unit 11 initially hits the reflection surface of the pin unit 5 and is successively reflected to be received by the receiver unit 12. Therefore, the moving distance of the selected weight blocks can be calculated. The data collection box can obtain and analyze the collected data for further references. Notably, the free rotation of the triangle configuration of the rotatable pin unit 5 due to gravity thereof may assure the correct horizontal arrangement of the reflection surface advantageously. Understandably, the pin unit may be not rotatable but with the absolute securing relation with regard to the weight block. Anyhow, the reflection surface of the reflection section 51 is expected to be perpendicular to the imaginary center line of the transmitter unit 11 and the receiving unit 12 for maximizing the sensing effect.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. A weight training equipment comprising:

a frame with a plurality of weight blocks thereon, each weight block forming a hole;

an ultrasonic sensor assembly including a case enclosing a transmitter unit and a receiver unit facing upwardly;

a rotatable pin unit including an upper insertion section and a lower reflection section freely rotatable relative to the upper insertion section; wherein the upper insertion section has a pin configuration and is selectively inserted into the hole of the corresponding weight block to have the reflection surface automatically arranged, via free rotation of the lower reflection section of the rotatable pin unit due to gravity thereof, in a balanced correct horizontal manner to allow the transmitter unit and the receiver unit to face the reflection section in a perpendicular manner.

2. The weight training equipment as claimed in claim 1, wherein the case is rotatably mounted upon a support.

3. The weight training equipment as claimed in claim 2, wherein said support forms a pair of pivot shafts and the case form a pair of pivot holes receiving the pivot shafts for rotation thereabouts.

4. The weight training equipment as claimed in claim 1, wherein the rotatable pin unit forms a configuration of an isosceles triangle.

5. The weight training equipment as claimed in claim 4, wherein the pin configuration of the insertion section of the pin unit horizontally extends from a top apex region of the isosceles triangle.

6. The weight training equipment as claimed in claim 1, wherein the case having a cylindrical configuration and includes a first part and a second part each having a semi-cylindrical configuration, and one of the first part and the second part has a pair of through hole to receive the corresponding transmitter and the receiver, respectively.

7. A method of measuring exercising effect for weight training, comprising:

providing a weight training equipment with a plurality of weight blocks, an ultrasonic sensor assembly and a rotatable pin unit wherein the ultrasonic sensor assembly includes a transmitter unit and a receiver unit, and the pin unit includes a reflection surface;

positioning the ultrasonic sensor assembly under the pin unit;

selectively inserting the pin unit into a selected weight block to have the reflection surface correctly downwardly face the ultrasonic sensor assembly by free rotation of the reflection section of said pin unit due to gravity thereof relative to the selected weight block.

8. The method as claimed in claim 7, wherein said pin unit defines an isosceles triangle configuration.

9. The method as claimed in claim 7, wherein the transmitter unit and the receiver unit are both enclosed within a case which is rotationally supported upon a support.

10. The method as claimed in claim 9, wherein the support forms a pair of pivot shafts, and the case forms a pair of pivot holes receiving such pivot shafts, respectively, for rotation.

11. The weight training equipment as claimed in claim 4, wherein the lower reflection section includes a bottom region and a pair of oblique regions arranged in said isosceles triangle, and said bottom region is kept at a lowest position constantly via free rotation of the lower reflection section of the rotatable pin unit due to gravity thereof.

12. The method as claimed in claim 8, wherein the reflection surface is constantly at a lowest position due to gravity of the pin unit.

* * * * *